US007641186B2

(12) United States Patent
Asai et al.

(10) Patent No.: US 7,641,186 B2
(45) Date of Patent: Jan. 5, 2010

(54) SHEET FEEDING/CONVEYING METHOD AND SHEET FEEDING/CONVEYING APPARATUS

(75) Inventors: Yasuyuki Asai, Tokyo (JP); Noboru Shimoyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 296 days.

(21) Appl. No.: 11/165,166

(22) Filed: Jun. 24, 2005

(65) Prior Publication Data

US 2006/0001724 A1 Jan. 5, 2006

(30) Foreign Application Priority Data

Jul. 1, 2004 (JP) ..... 2004/195455

(51) Int. Cl.
*B65H 3/06* (2006.01)

(52) U.S. Cl. ..... 271/117; 271/242; 271/125; 271/114; 271/10.12

(58) Field of Classification Search ..... 271/242, 271/124, 125, 114, 117, 10.12
See application file for complete search history.

(56) References Cited

U.S. PATENT DOCUMENTS 5,154,412 A * 10/1992 Iseda ..... 271/227
5,253,854 A * 10/1993 Tanoue et al. ..... 271/10.12
5,887,867 A * 3/1999 Takahashi et al. ..... 271/117
5,909,872 A * 6/1999 Takahashi ..... 271/116
5,975,516 A * 11/1999 Maruchi et al. ..... 271/10.12
6,331,002 B1 12/2001 Yoshino et al. ..... 271/117
6,641,132 B2 * 11/2003 Sekine ..... 271/124
6,824,132 B2 11/2004 Asai et al. ..... 271/125
7,234,695 B2 * 6/2007 Tsukamoto et al. ..... 271/122
2003/0230844 A1 12/2003 Shimoyama ..... 271/127
2004/0188916 A1 * 9/2004 Tsukamoto et al. ..... 271/110
2006/0001724 A1 1/2006 Asai et al. ..... 347/104
2006/0180990 A1 * 8/2006 Ueda et al. ..... 271/121

FOREIGN PATENT DOCUMENTS

JP 62-215445 9/1987
JP 62215445 A * 9/1987
JP 5-24722 2/1993

* cited by examiner

*Primary Examiner*—Patrick H Mackey
*Assistant Examiner*—Gerald W McClain
(74) *Attorney, Agent, or Firm*—Fitzpatrick, Cella, Harper & Scinto

(57) ABSTRACT

A sheet material feeding apparatus has a rotatable pressure plate for stacking sheet materials, a pickup roller for feeding the sheet material stacked on the pressure plate, a feed roller for feeding the sheet materials fed by the pickup roller and a separation roller contactable with the feed roller. A registration roller corrects oblique feeding of the sheet material by being abutted against the separated sheet material by the feeding roller and the separation roller, and after the registration roller rotates in synchronism with the pickup roller and the feed roller to start feeding the sheet material, pressure of the pressure plate against the pickup roller is released, and thereafter the feed roller and the separation roller are spaced apart from one another.

5 Claims, 9 Drawing Sheets

SHEET FEEDING/CONVEYING METHOD AND SHEET FEEDING/CONVEYING APPARATUS

FIELD OF THE INVENTION AND RELATED ART

The present invention relates to a sheet feeding/conveying method and a sheet feeding/conveying apparatus, which are employed by a recording apparatus and an image forming apparatus, such as a printer, a copying machine, a printing apparatus, a facsimileing machine, etc., and an image reading apparatus, such as a scanner, to convey ordinary sheets or cardstock of recording medium, copying medium, originals, or the like to the recording portion, copying portion, reading portion, or the like, while separating them one by one. It also relates to a recording apparatus which employs such a sheet feeding/conveying method and a sheet feeding/conveying apparatus.

A conventional sheet feeding/conveying apparatus employed by a recording apparatus or the like comprises: a sheet raising mechanism for raising multiple sheets of recording medium (recording paper or the like) in the sheet feeder tray, to a predetermined level; a pickup roller for conveying the sheets of recording medium held at the predetermined level to a sheet separating portion; a combination of a feed roller and a sheet separating mechanism, for conveying further the sheets of recording medium delivered thereto while separating them one by one; and a leading edge alignment mechanism for properly positioning the leading edge of each sheet of recording medium by temporarily bending the portion of the sheet of recording medium between the leading edge aligning roller and feed roller by driving the sheet of recording medium forward while holding in place the leading edge of the sheet of recording medium against the nip between the leading edge alignment roller and the feed roller. As for a conventional recording apparatus, it is provided with: a platen for supporting each sheet of recording medium while the sheet is conveyed by the rotation of the leading edge alignment roller; a recording portion which records an image or the like on the sheet of recording medium in response to electrical signals while the sheet of recording medium is on the platen; and a sheet discharging portion which discharges each sheet of recording medium into a delivery tray after the recording.

According to the invention disclosed in Japanese Laid-open Patent Application 62-215445, in order to reduce the so-called back tension, that is, a substantial amount of load to which the sheet feeding/conveying apparatus is subjected when feeding and conveying a sheet of recording medium, not only is a sheet feeding/conveying means is provided with a sheet conveying means made up of a pickup roller and a feed roller, but also, a sheet pinching means (pinch roller) for securely holding the sheet of recording medium by its trailing end, in coordination with the removal of the pressure applied to the sheet of recording medium by the pickup roller and separating means (separation roller), as the sheet of recording medium is caused to arc by a predetermined amount after the arrival of the leading edge of the sheet of recording medium at the leading edge alignment mechanism.

According to the invention disclosed in Japanese Laid-open Patent Application 5-24722, for the purpose of making it easier for a possibly askew cardstock to straighten itself as it is made to come into contact with the leading edge alignment roller, the pickup roller is moved away from the cardstock before the cardstock reaches the leading edge aligning roller.

However, the sheet feeding/conveying apparatus in accordance with the prior art suffered from the following problems.

In the case of a structural arrangement for a sheet feeding/conveying apparatus, such as the one disclosed in Japanese Laid-open Patent Application 62-215445, a holding means for holding the trailing portion of a sheet of recording medium, and also, the mechanism for driving the holding means, the action of which is tied to the operations for releasing the sheet of recording medium from the feeding/conveying means and separating means, are necessary in addition to the feeding/conveying means, separating means, and leading edge aligning means (registering means). Thus, the sheet feeding/conveying means is provided with various additional mechanisms, for example, a plurality of solenoid, levers, stoppers, and the like, for reducing the so-called back tension. Not only does this complicate the sheet feeding/conveying apparatus in structure, increasing thereby the cost of the sheet feeding/conveying apparatus, but also, complicating the driving of the sheet feeding/conveying apparatus.

In the case of a structural arrangement for a sheet feeding/conveying apparatus, such as the one disclosed in Japanese Laid-open Patent Application 5-24722, the pickup roller is moved away from a sheet of recording medium before the sheet of recording medium reaches the leading edge alignment roller, creating thereby a situation in which the sheet of recording medium is conveyed by the feed roller alone, being therefore liable to be easily affected by the frictional resistance which occurs between the sheet of recording medium and the various portions of the sheet conveyance passage. In such a situation, the difference between the distance by which the left side of the sheet of recording medium is conveyed and the distance by which the right side of the sheet of recording medium is conveyed becomes substantial, making the sheet of recording medium too skewed for the leading edge of the sheet of recording medium to be satisfactorily straightened by the leading edge alignment roller.

SUMMARY OF THE INVENTION

The primary object of the present invention is to provide a sheet feeding/conveying apparatus which is lower in cost, simpler in structure, smaller in the so-called back tension, and capable of more easily and efficiently straightening a possibly askew sheet of recording medium than a sheet feeding/conveying apparatus in accordance with the prior art.

According to an aspect of the present invention, there is provided a sheet material feeding apparatus comprising feeding means for contacting to the sheet material which is in a stand-by state and picking the sheet material up; separating means for press-contacting to the sheet material picked up by said feeding means to single out the sheet material; registration means for stopping the sheet material which is picked up by said feeding means and singled out by said separating means and temporarily retaining the sheet material with a leading end in abutment thereto; and releasing means for releasing the sheet material from a press-contact state provided by said separating means and said feeding means, after said registration means and said feeding means start refeeding the sheet material by releasing the temporay retaining of said registration means.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENT

Figure 1:
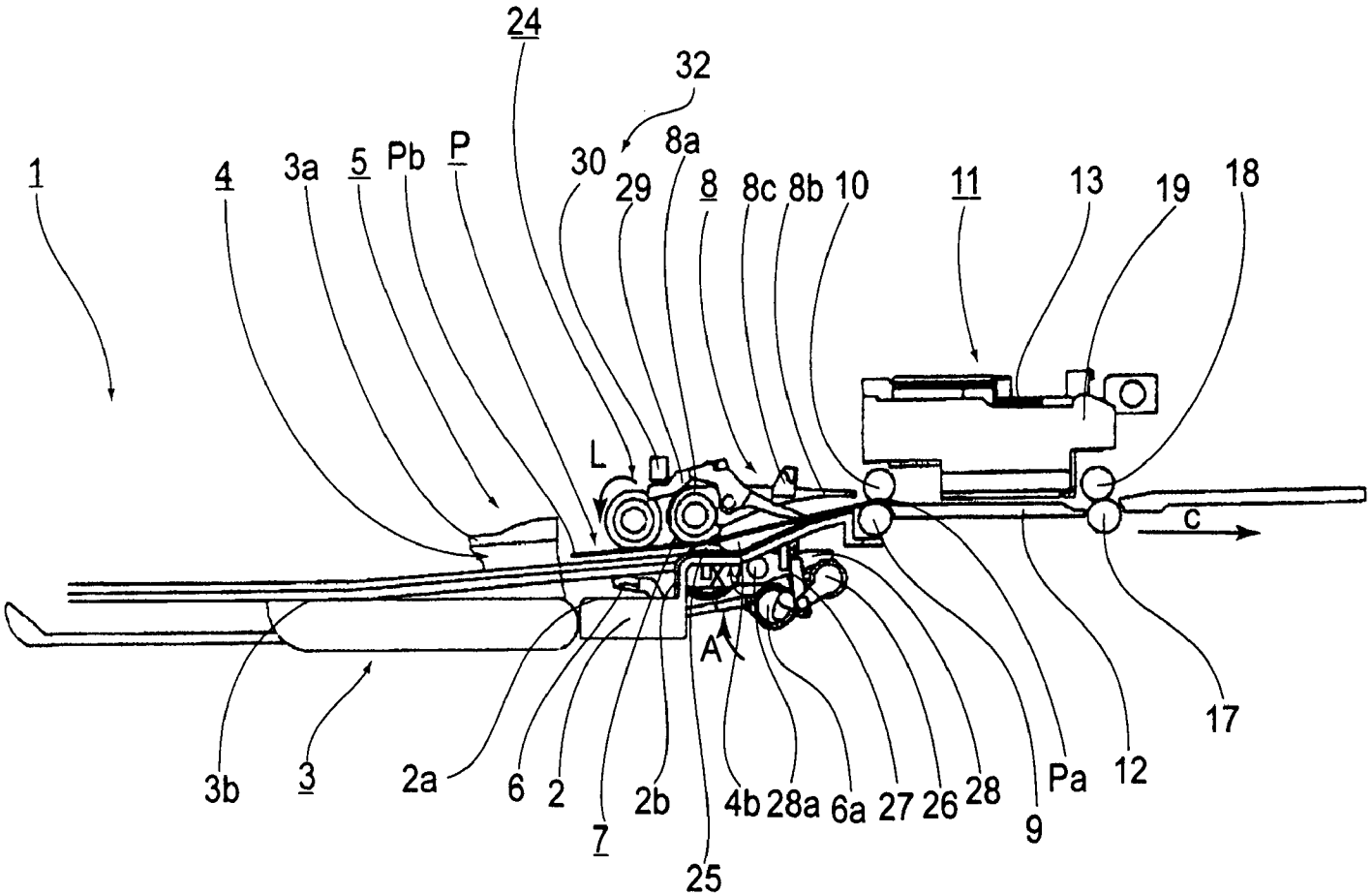
FIG. 1 is a schematic drawing of a printer having the sheet feeding/conveying apparatus in the first embodiment of the present invention, which describes the sheet feeding/conveying operation of the printer.

Hereinafter, one of the preferred embodiments of the present invention will be described with reference to the appended drawings.

FIGS. 1-7 show an ink jet printer 1 having the sheet feeding/conveying apparatus 32 in one of the preferred embodiments of the present invention. This ink jet printer 1 is essentially made up of the sheet feeding/conveying apparatus 32 and a recording portion 11. First, the structure of the sheet feeding/conveying apparatus 32 will be described.

The sheet feeding/conveying apparatus 32 is provided with a sheet tray 3 capable of holding a substantial number of sheets P of recording medium (paper) of a predetermined size. The sheet tray 3 is located on one side (left side) of the case 31 (FIG. 6) of the ink jet printer 1. The sheet tray 3 has top and bottom portions, which are divided by a partition plate 3*a*. That is, the sheet tray 3 has a sheet feeder portion 4, that is, the bottom tray, in which unrecorded sheets of recording medium are storable, and a sheet delivery portion 5, that is, the top portion, into which recorded sheets of recording medium are discharged from the recording portion 11 to be placed in layers. The recording portion 11 will be described later. The sheet feeder portion 4 is where unrecorded sheets of recording medium are kept on standby to be immediately available for recording. The sheet delivery tray 5 is in the immediate adjacencies of the recording medium preparation position, to catch the recorded sheets P of recording medium. The sheet feeder tray 4 is made up of a portion 3*b* and a portion 2*a*. The portion 3*b* is a part of the sheet tray 3, whereas the portion 2*a* is a part of the feeder tray base 2 of the sheet feeding/conveying apparatus. To the portion 2*a* of the feeder tray base 2, a pressure plate 6 is attached, being rendered rotatable about an axle 6*a*. More specifically, the pressure plate 6 is rendered pivotal about the axle 6*a*, with which the one end of the pressure plate 6 is provided. The other end of the pressure plate 6 is kept pressured by unshown springs in the direction indicated by an arrow mark A, and can be raised or lowered by the cam of a control gear 14, through a control shaft 26. The control gear 14 will be described later. The unrecorded sheets P of recording medium are placed on the pressure plate 6.

The feeder tray base 2 of the sheet feeder tray 4 is provided with a sheet alignment rib 2, against which the sheets P of recording medium are aligned in the vertical direction. Thus, a pickup roller 24 is disposed next to the sheet alignment rib 2*b*, in terms of the horizontal direction, while being above the pressure plate 6 in terms of the vertical direction. On the downstream side of the pickup roller 24 in terms of the direction (indicated by arrow mark C) in which the sheets of recording medium are conveyed (which hereinafter may be referred to simply as sheet conveyance direction), a feed roller 7 is disposed. Below this feed roller 7, a separation roller 25 is disposed, which is for further conveying, while separating one by one, the plurality of sheets of recording medium delivered thereto by the pickup roller 24. The separation roller 25 does not have a power source, but is provided with a torque limiter. The separation roller 25 is supported by a separation roller holder 28, which is pivotal about an axle 28*a*. Further, the separation roller 25 is kept pressed toward the feed roller 7 by unshown springs. Thus, it can be pivoted, together with the separation roller holder 28, about the axle 28*a* by the cam of the control gear 14, through the control shaft 26. The control gear will be described later. The feed roller 7, pickup roller 24, and separation roller 25 are all cylindrical, and their peripheral surface portions are formed of such a substance as rubber, which is relatively high in coefficient of friction. They are rotatable in the counterclockwise direction (direction indicated by arrow mark L).

Although the sheet feeding/conveying apparatus in this embodiment employs such a sheet separation mechanism as that described above, the choice of the sheet separation mechanism does not need to be limited to the above described sheet separation mechanism or the like. For example, it may be a sheet separation mechanism which employs a separation pad.

The base portion 8*a* of a flapper 8 is pivotally attached to the rotational axle of the feed roller 7 so that the rotational axis of the flapper 8 coincides with that of the feed roller 7. The flapper 8 is provided with a tong-like plate 8*b*, which extends from the base portion 8*a* toward a registration roller 9 (leading edge alignment roller). As the flapper 8*a* is pivoted upward or downward, the sheet outlet 4*b* of the sheet feeder portion 4 is opened or closed, respectively. More specifically, the flapper 8 is pivotally movable by the cam follower 8*c* of the flapper 8, the cam portion 14*a* (FIG. 7), and a flapper moving mechanism, to open or close the sheet outlet 4*b*. The rotational axis of the cam portion 14*a* coincides with that of the control gear 14 (FIG. 6), which will be described later.

In terms of the sheet conveyance direction (direction indicated by arrow mark C), the registration roller 9, and a roller 10, which is kept pressed on the registration roller 9, are disposed downstream of the feed roller 7 while being upstream of the recording portion 11. Also in terms of the sheet conveyance direction (direction of arrow mark C), a sheet conveyance roller 17, and a roller 18 which is kept pressed on the sheet conveyance roller 17, are disposed downstream of the recording portion 11. The registration roller 9 and sheet conveyance roller 17 are rotatable in both the clockwise and counterclockwise directions. The rollers 10 and 18 follow the rotation of the registration roller 9 and sheet conveyance roller 17, respectively. While being pinched by either one, or both, of the combination of the registration roller 9 and roller 10 and the combination of the sheet conveyance roller 17 and roller 18, each sheet P of recording medium can be conveyed in the direction indicated by the arrow mark C by the clockwise rotation of one or both of the rollers 9 and 17, or in the sheet discharging direction indicated by an arrow mark D by the counterclockwise rotation of one or both of the rollers 9 and 17.

The recording portion 11 in this embodiment is made up of a platen 12, a head 13, and a carriage 19. The platen 12 is wider than the width of the sheet P of recording medium. The head 13 is disposed above the platen 12, and ejects recording ink. The carriage 19 moves the head 13 in the direction parallel to the width direction of the sheet P of recording medium.

Figure 6:
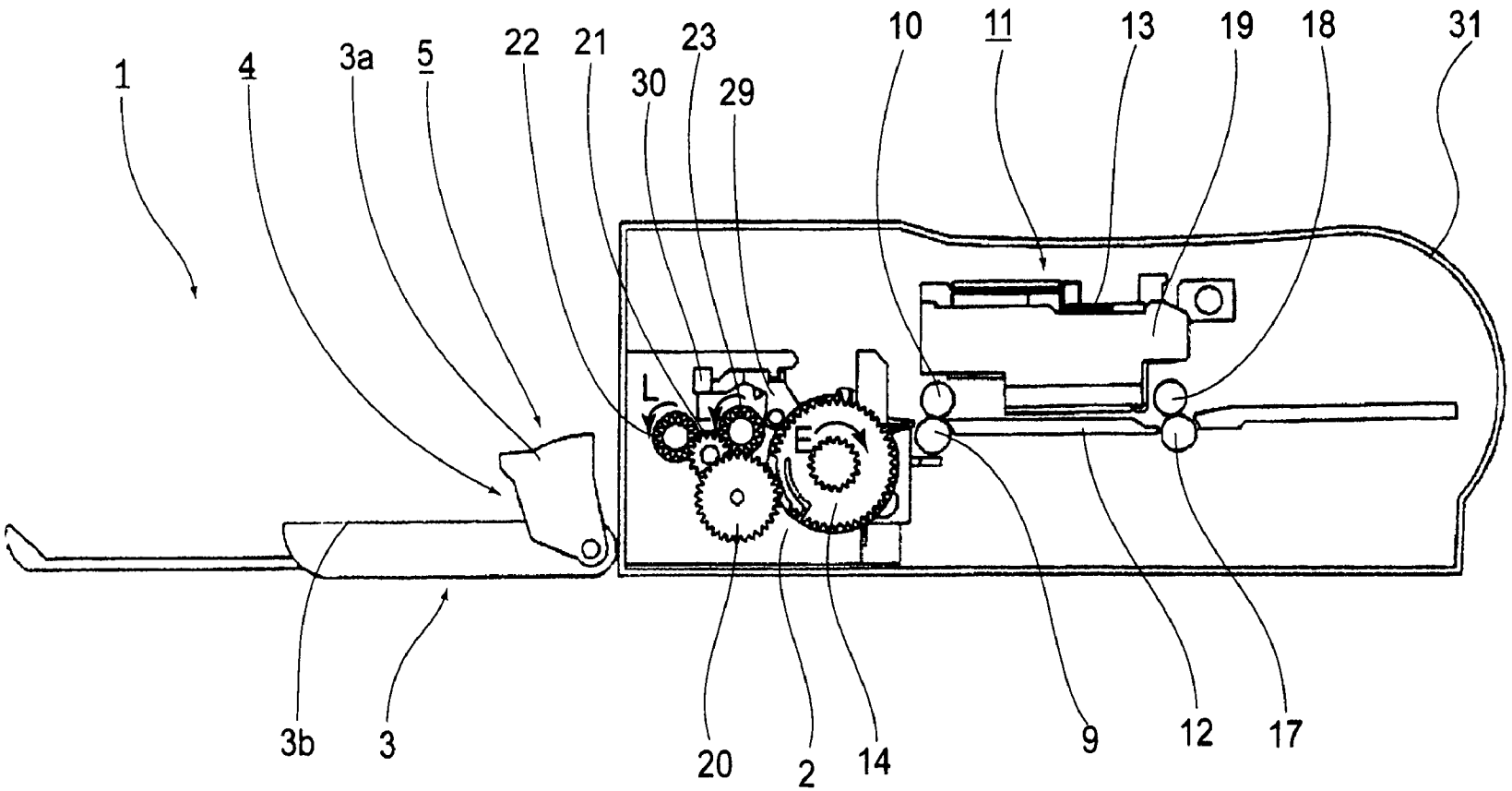
FIG. 6 is a schematic drawing of one of the essential portions of the driving apparatus of a printer having the sheet feeding/conveying apparatus in the first embodiment of the present invention.
Figure 7A:
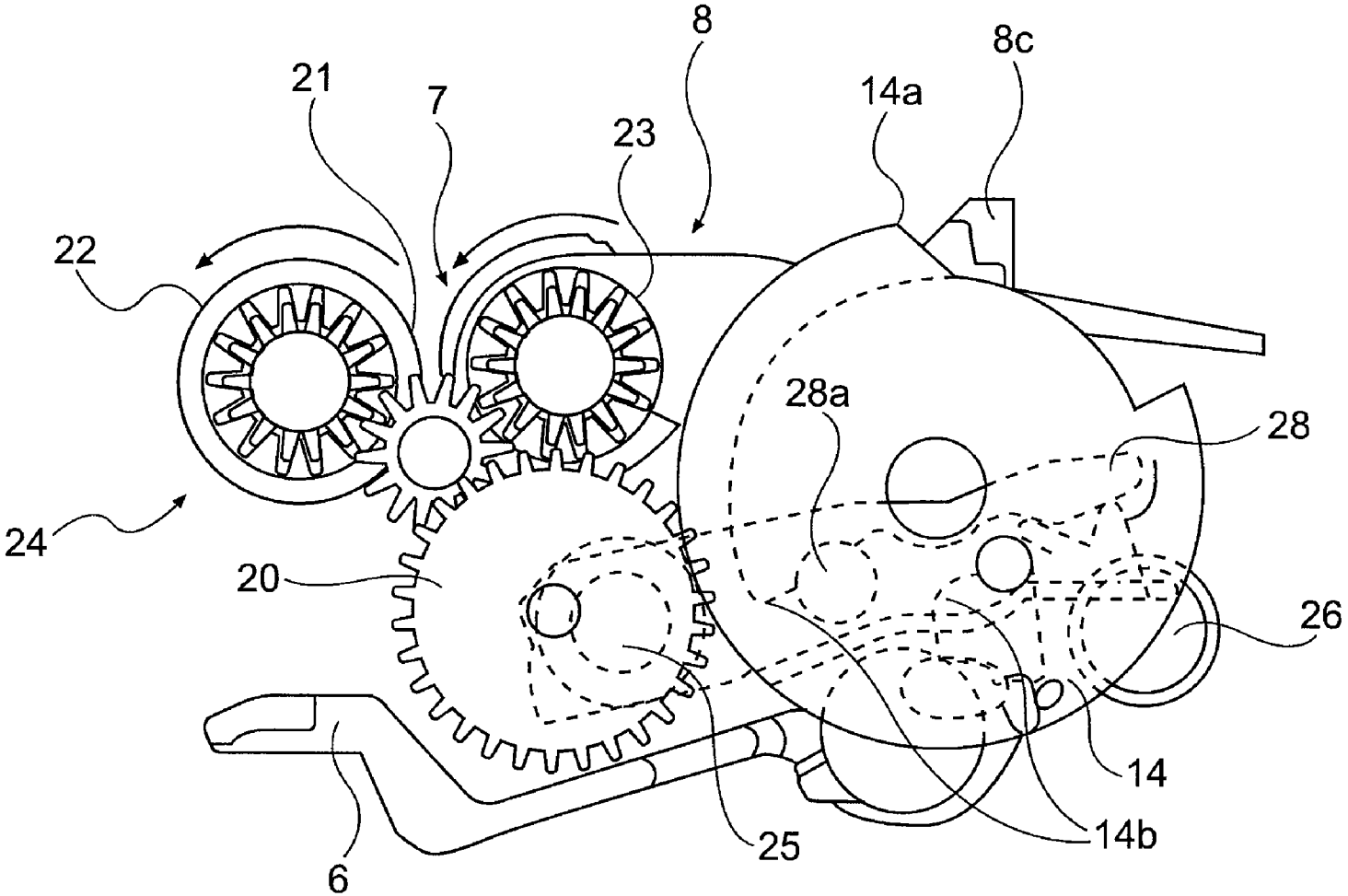
FIG. 7 is an enlarged view of the essential portion in FIG. 7, which describes the operation of the essential portion.
Figure 7B:
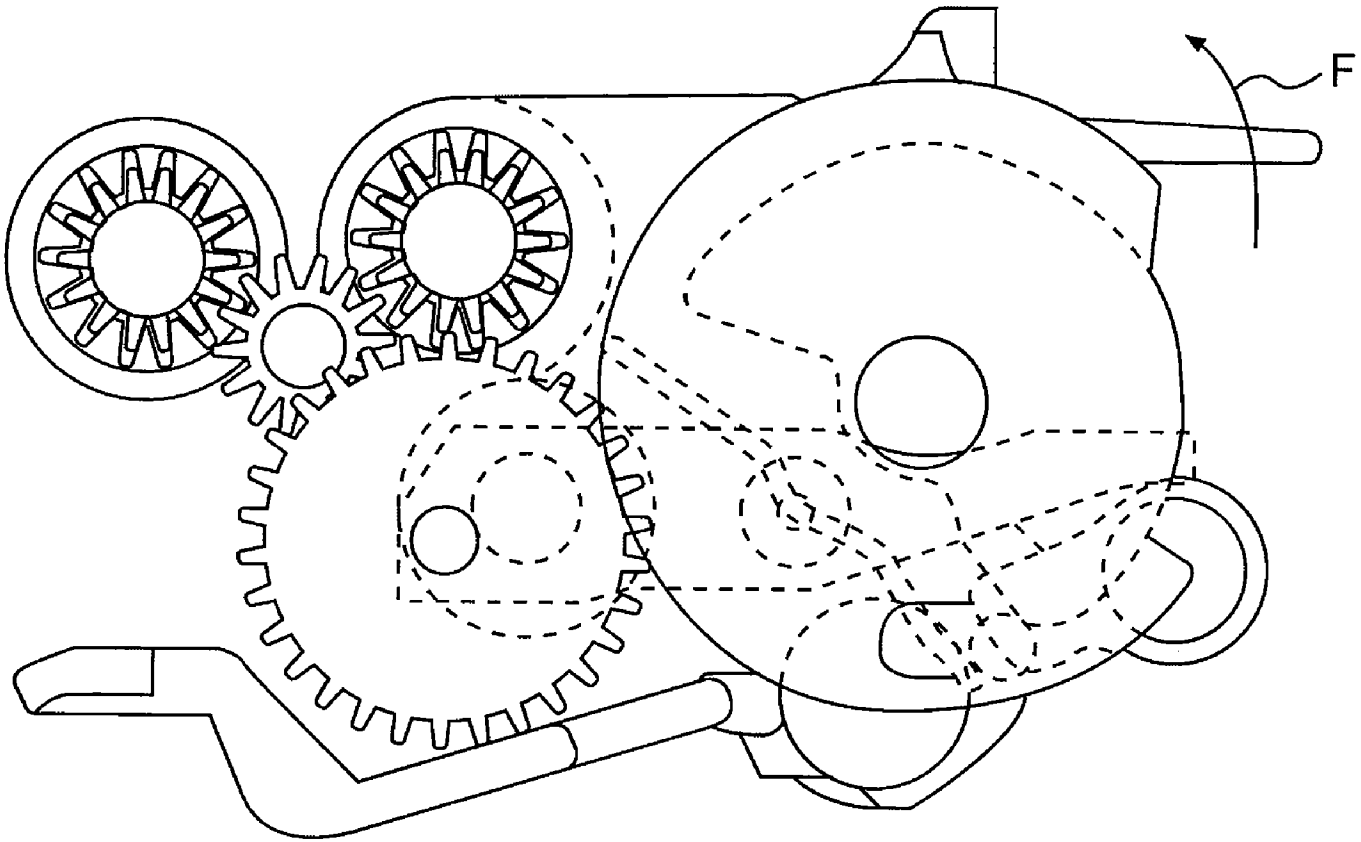
Figure 7C:
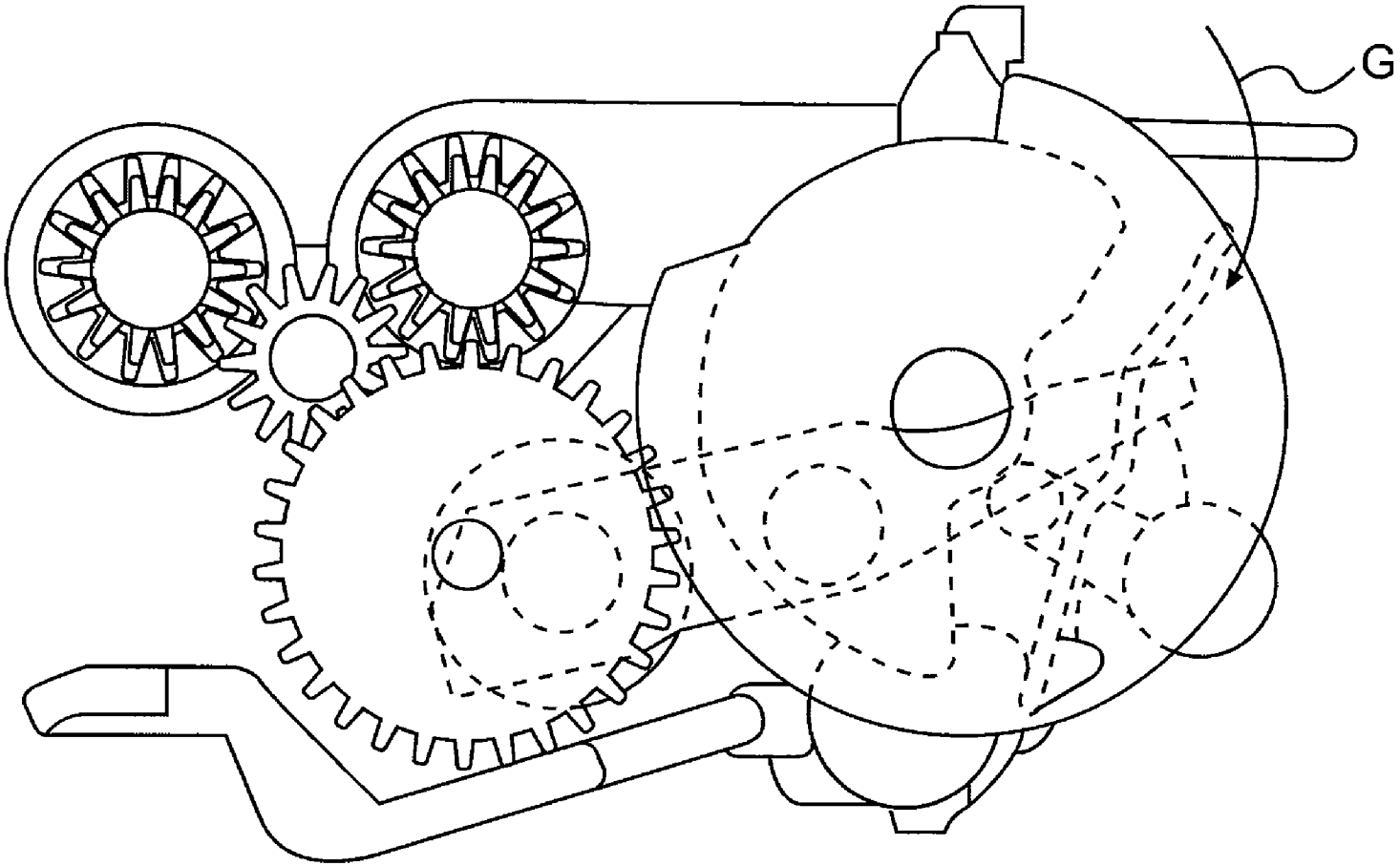

Next, the mechanisms for driving the abovementioned members will be described. Referring to FIGS. 6 and 7, an unshown motor is indirectly engaged with a pickup roller gear 22 and a feed roller gear 23, through a double gear 20 and an idler gear 21. The pickup roller gear 22 and pickup roller 24 are coaxial and are rotatable together, and the feed roller gear 23 and feed roller 7 are coaxial and are rotatable together. Referring to FIG. 7, the control gear 14 is provided with a cam portion 14*b* (contoured with broken line), which is on the back side of the control gear 14. This cam portion 14*b* engages with the control shaft 26, through which it acts on the separation roller 25 and the pressure plate 6 of the sheet tray 3. The cam portion 14*a*, which also is coaxial with the control gear 14, engages with the cam follower 8*c* of the flapper 8, as shown in FIG. 7(*b*), and controls the pivotal movement (indicated by arrow mark F) of the tong-like portion 8*b* of the flapper 8.

Figure 2:
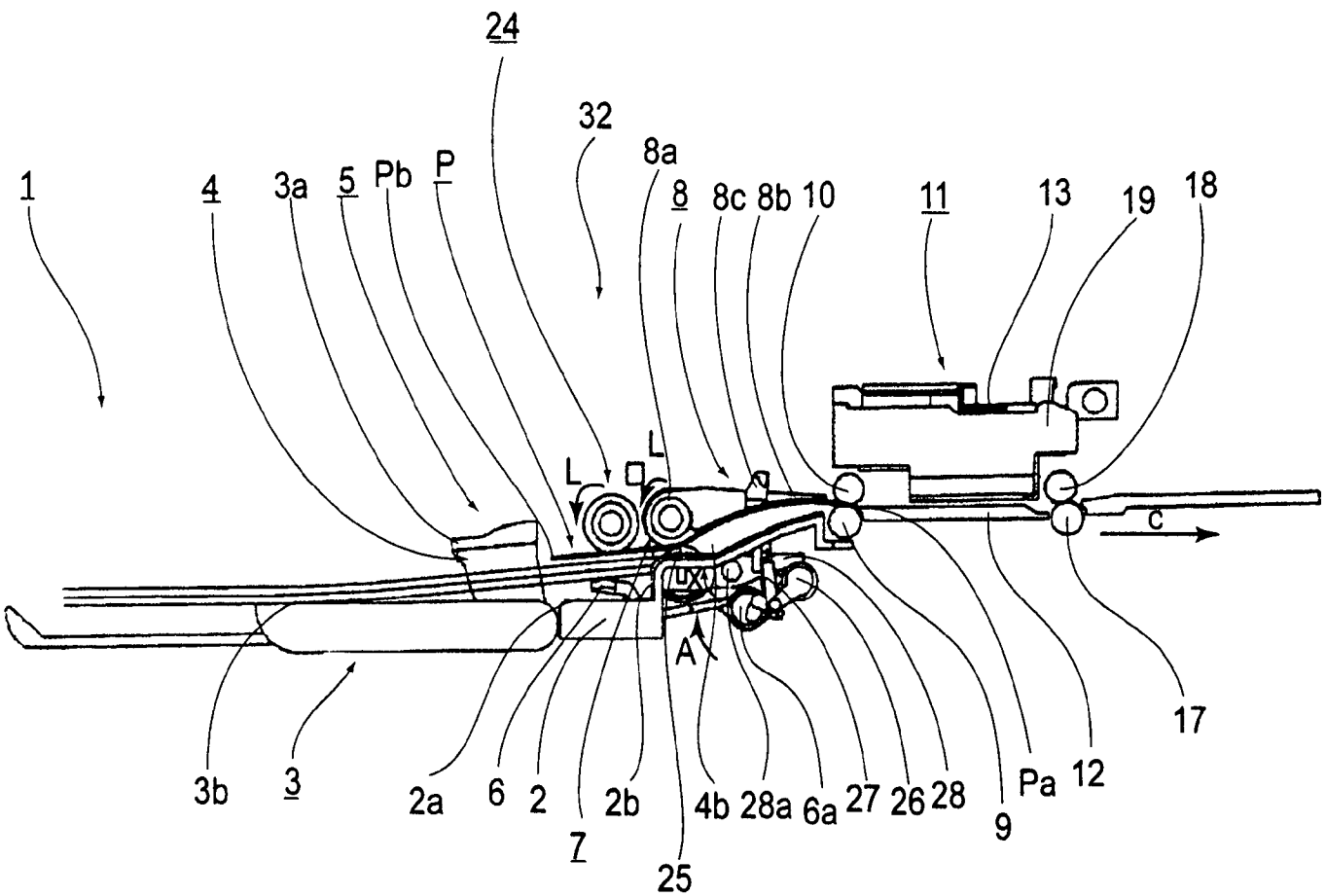
FIG. 2 is a schematic drawing of a printer having the sheet feeding/conveying apparatus in the first embodiment of the present invention, which describes the sheet registering step which follows the sheet feeding/conveying step showing in FIG. 1.

Referring to FIGS. 1 and 2, in the adjacencies of the pickup roller 24 and feed roller 7, a sheet detection lever 30 for detecting the presence of the sheet P of recording medium, and a sheet detection sensor 29 for detecting the presence of the sheet P of recording medium, are disposed, respectively.

Next, the operation of the ink jet printer 1 which employs the sheet feeding/conveying apparatus 32 in this embodiment of the present invention will be described.

When an image is formed on the sheet P of recording medium with the use of the ink jet printer 1 having the sheet feeding/conveying apparatus 3 in this embodiment, first, the control gear 14 rotates in the direction indicated by an arrow mark E as shown in FIG. 7(*a*), causing the cam portion 14*b* on the back side of the control gear 14 to act on the separation roller 25 and pressure plate 6, shown in FIG. 1 and FIG. 7(*b*), through the control shaft 26. As a result, the separation roller 25 is raised in the direction indicated by an arrow mark X in FIGS. 1 and 2, being thereby pressed on the feed roller 7. Then, the pressure plate 6 of the sheet tray 3 holding plural sheets P of recording medium is raised in the direction of an arrow A, causing the topmost sheet P of recording medium on the pressure plate 6 to be pressed on the bottom portion of the pickup roller 24. Meanwhile, the separation roller holder 28, which is holding the separation roller 25 kept pressured toward the feed roller 7 by unshown springs, is pivoted about the rotational axle 28*a*.

While the topmost sheet P is kept pressed on the pickup roller 24, the pickup roller gear 22 is driven (FIGS. 6 and 7) by an unshown motor through the double gear 20 and idler gear 21, rotating therefore the pickup roller 24, which is coaxial with the pickup roller gear 22, in the direction of an arrow mark L. Consequently, a few sheets P of recording medium are sent to the nip between the feed roller 7 and separation roller 25. Then, only the topmost of the few sheets P is separated from the rest by the sheet separation mechanism comprising the separation roller 25, etc., and is conveyed in the direction of the arrow mark C.

Figure 4:
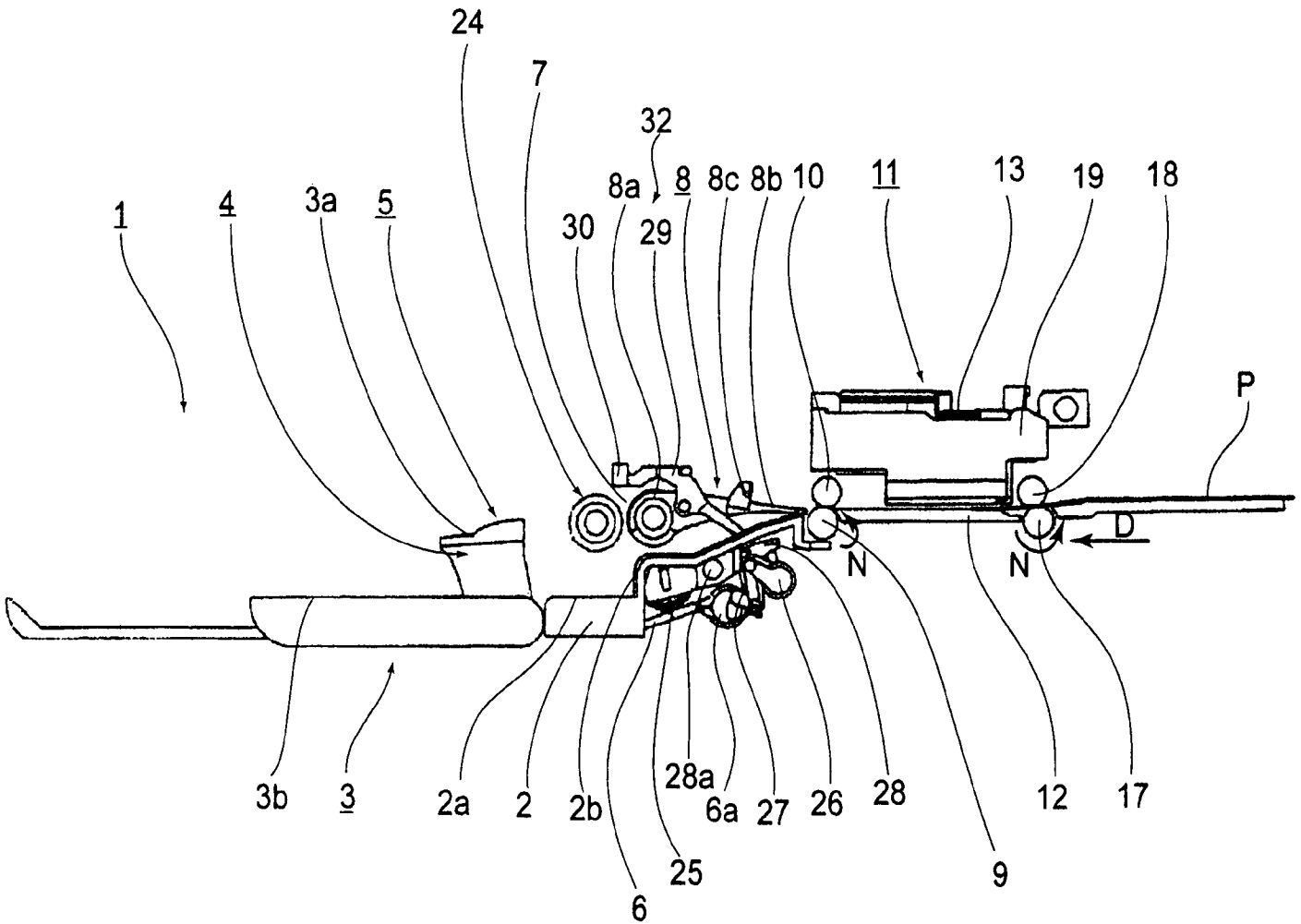
FIG. 4 is a schematic drawing of a printer having the sheet feeding/conveying apparatus in the first embodiment of the present invention, which describes the sheet feeding/conveying step in which a sheet of recording medium is conveyed to be discharged, and which follows the sheet feeding/conveying step shown in FIG. 3.
Figure 5:
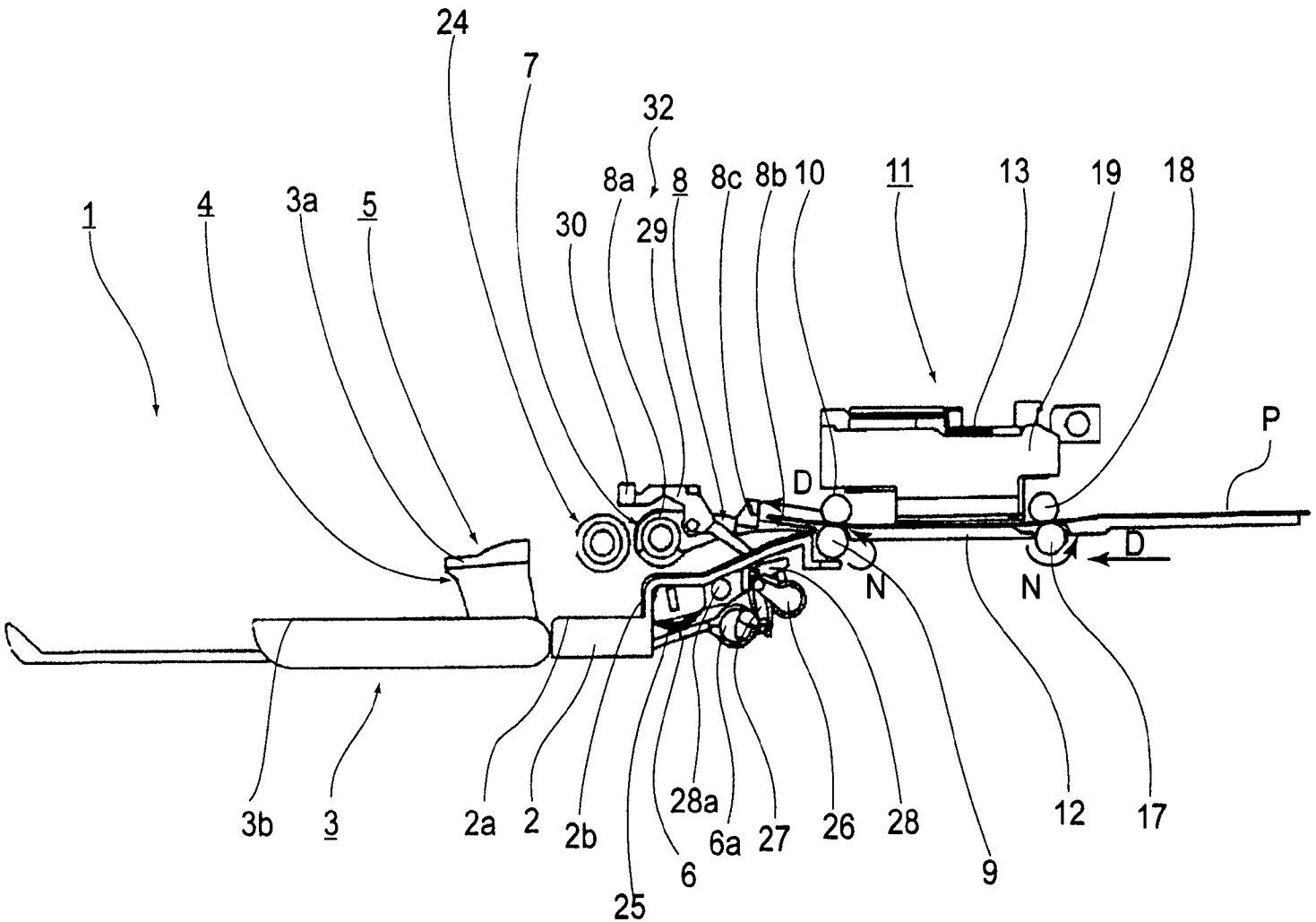
FIG. 5 is a schematic drawing of a printer having the sheet feeding/conveying apparatus in the first embodiment of the present invention, which describes the sheet feeding/conveying step in which a sheet of recording medium is conveyed to be discharged, and which follows the sheet feeding/conveying step shown in FIG. 5.

Meanwhile, the flapper 8 comprising the cam follower 8*c* and tong-like portion 8*b* (FIG. 1) is pivoted upward (direction of arrow mark F) by the rotation of the cam portion 14*a* shown in FIG. 7(*b*), opening thereby the sheet outlet 4*b* of the sheet tray 3. Therefore, the topmost sheet P of recording medium sent out of the sheet feeder portion 4 of the sheet tray 3 moves past the sheet outlet 4*b* without touching the bottom surface of the flapper 8, and is conveyed toward the recording portion 11. As soon as the feeding of the topmost sheet P from the sheet feeding portion 4 ends, the flapper 8 is pivoted downward, whereby the sheet outlet 4*b* is closed by the tong-like portion 8*b* of the flapper 8, as shown in FIGS. 4 and 5.

Then, the sheet P of recording medium sent out in the sheet feeding direction (indicated by arrow mark C) moves past the sheet detection lever 30, and the leading edge Pa of the sheet P comes into contact with the nip between the registration roller 9 and roller 10. At this moment, the registration roller 9 is not being rotated, but the pickup roller 24 and feed roller 7 are still being rotated. Therefore, the sheet P is pushed forward by the pickup roller 24 and feed roller 7 while being temporarily held in place at the most forward point of the leading edge Pa by the registration roller 9 (FIG. 1). As a result, the sheet P is forced to arc (FIG. 2). Consequently, the entirety of the leading edge Pa is placed in contact with the peripheral surface of the registration roller 9. In other words, even if the sheet P has been rendered askew while it is fed from the sheet feeder portion 4 and conveyed further by the rotation of the pickup roller 24 and feed roller 7, the area of the leading edge Pa, which is slightly behind the most forward point of the leading edge Pa in terms of the sheet movement, is caused to come into contact with the peripheral surface of the registration roller 9, that is, caused to catch up with the most forward point, while the sheet P is temporarily held by the registration roller 9 at the most forward point of the sheet P, that is, the point in contact with the nip (while sheet P is arcing). That is, at this point, the entirety of the leading edge Pa of the sheet P comes into contact with the peripheral surface of the registration roller 9, being thereby rendered perpendicular to the sheet conveyance direction. In other words, the sheet P, which possibly has been conveyed askew, is straightened. Incidentally, the length by which the sheet P is caused to arc, is set to a value large enough to straighten the sheet P, in consideration of the possible degree of skewness at which the sheet P is conveyed. More specifically, the length by which the forward portion of the sheet P is caused to arc can be calculated based on the distance by which the sheet P is conveyed after the sheet detection sensor 29 responds to the sheet P having moved past the sheet detection lever 30 (distance by which sheet P is conveyed by pickup roller 24 and feed roller 7). Then, the value obtained by the calculation is used to start the rotation of the registration 9 as soon as the forward portion of the sheet P is caused to arc by a predetermined length.

While the leading edge Pa of the sheet P is correctly positioned, the trailing edge Pb of the sheet P or the portion of the sheet P adjacent to the trailing edge Pb are held pressed upon the pickup roller 24, feed roller 7, and separation roller 25. Therefore, it does not occur that because the sheet P is insecurely held, it becomes too skewed to be easily straightened by the registration roller 9, before it comes into contact with the registration roller 9.

Figure 3:
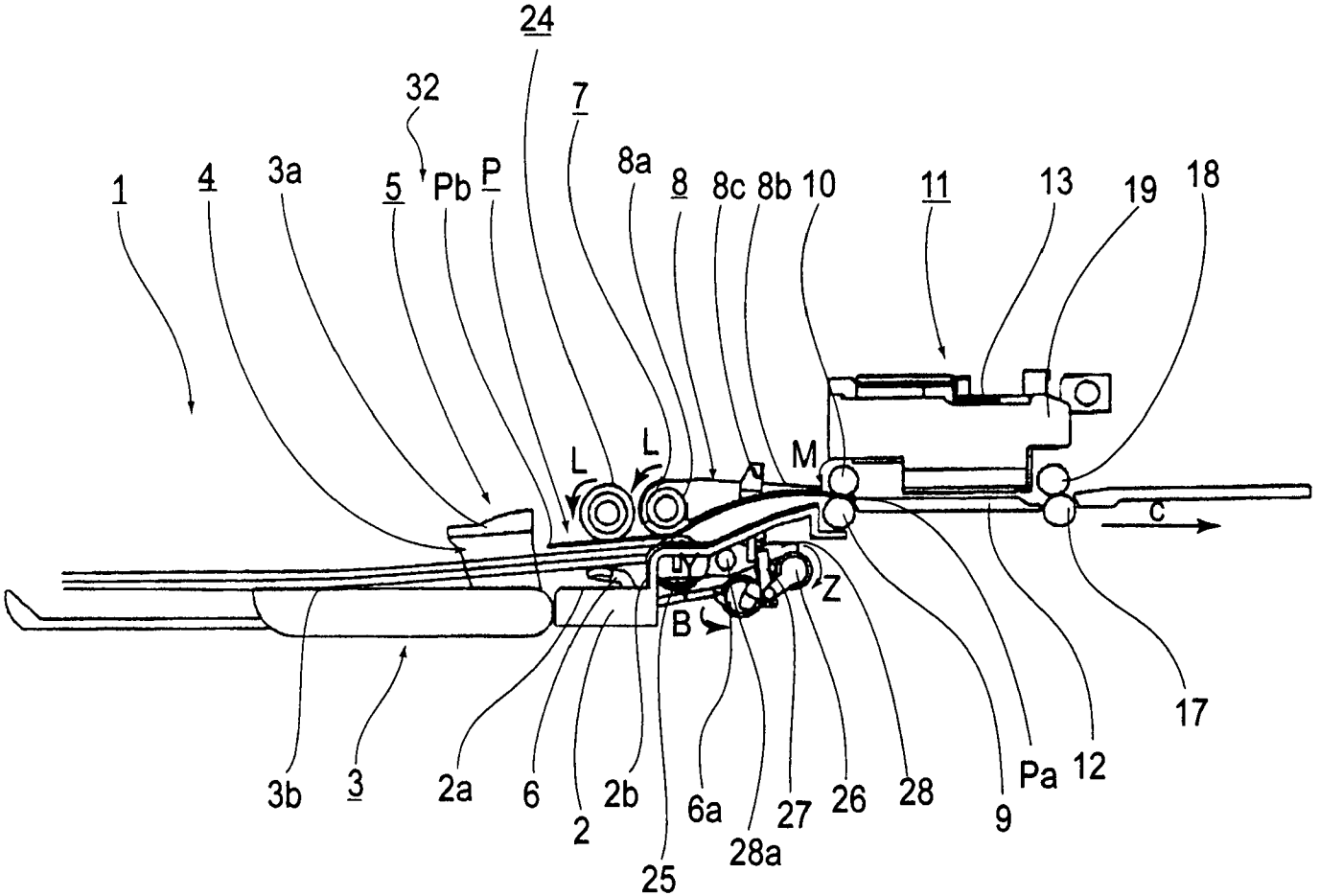
FIG. 3 is a schematic drawing of a printer having the sheet feeding/conveying apparatus in the first embodiment of the present invention, which describes the sheet conveyance step in which a sheet of recording medium is conveyed to record an image thereon, and which follows the sheet feeding/conveying step shown in FIG. 2.

Referring to FIG. 3, as the registration roller 9 begins to rotate in synchronism with the rotation of the pickup roller 24 and feed roller 7, the leading edge Pa of the arcuate sheet P is pinched by the registration roller 9 and roller 10. Then, as the control gear 14 is rotated, the pressure plate 6 is allowed to descend in the direction of the arrow B (FIG. 3) by the control shaft 26 which is in engagement with the cam portion 14*b* of the control gear 14, removing thereby the pressure kept applied to the sheets P in the sheet tray 3 to keep the sheets P against the pickup roller 24. Thereafter, the separation roller 25 is similarly allowed to separate from the feed roller 7 through the control shaft 26, removing thereby the pressure which has kept the sheet P pressed on the feed roller 7 and separation roller 25. Incidentally, the pressure which has kept the sheet P pressed on the pickup roller 24 is removed before the pressure which has kept the sheet P pressed on the feed roller 7 is removed. Therefore, it is prevented that two or more sheets P are conveyed together.

During this process, the rotation of the registration roller 9 is started, restarting the interrupted conveyance of the sheet P. In the case of the prior art, it is possible that the restarting did not occur smoothly because of the substantial amount of resistance (back tension) which occurs at the restarting of the interrupted conveyance of the sheet P, that is, at the moment the sheet P begins to move. In the case of this embodiment of the present invention, however, the trailing edge Pb of the sheet P, or the portion of the sheet P adjacent to the trailing edge Pb, remains held pressed on the pickup roller 24, feed roller 7 and separation roller 25 at the restarting of the interrupted conveyance of the sheet P, that is, at the moment the sheet P begins to move. Therefore, the back tension, which acts in the direction to move the sheet P backward, is kept under control, allowing the forward conveyance of the sheet P to be smoothly restarted. Then, as soon as the forward conveyance of the sheet P is started, the pressure kept applied to keep the sheet P on the pickup roller 24, feed roller 7, and separation roller 25 is removed, being thereby prevented from interfering thereafter with the conveyance of the sheet P.

Then, the registration roller 9 begins to be continuously rotated in the direction (indicated by arrow mark M) while the sheet P remains pinched by the registration roller 9 and roller 10. As a result, the sheet P is conveyed to the gap between the platen 12 and head 13, which are located downstream of the registration roller 9 in terms of the sheet conveyance direction. Then, the sheet P is pinched by the sheet conveyance roller 17 and roller 18, which are rotating in the same direction as the registration roller 9 and roller 10. As the sheet P is further conveyed in the sheet conveyance direction (indicated by arrow mark C), the trailing edge Pb leaves the flapper 8, and then, it becomes disengaged from the nip between the registration roller 9 and roller 10, reaching eventually the recording start point. Immediately after the trailing edge Pb of the sheet P leaves the flapper 8, the flapper 8 is pivoted downward (direction of arrow mark F) by the cam follower 8*c* of the flapper 8, and the cam portion 14*a* of the control gear 14, causing thereby the tong-like portion 8*b* of the flapper 8 to close the sheet outlet 4*b* of the sheet tray 3.

As described before, as the sheet P reaches the recording start position, the sheet conveyance roller 17 begins to be rotated in reverse (opposite direction, that is, direction of arrow mark N), to convey the sheet P in sheet discharging direction (direction of arrow mark D), as shown in FIG. 4. In synchronism with the conveyance of the sheet P in the sheet discharge direction, the carriage 19, which is holding the head 13, is moved in the width direction of the sheet P (direction intersectional to sheet discharge direction) to record on the sheet P. In other words, an intended image or the like is formed on the sheet P as the process of conveying the sheet P in the sheet discharge direction, and the process of ejecting ink from the head 13 while moving the carriage 19, are alternated.

The abovementioned conveyance of the sheet P in the sheet discharge direction is started by beginning rotating the sheet conveyance roller 17 while the trailing edge Pb of the sheet P remains pinched by the sheet conveyance roller 17 and roller 18. Thus, the trailing edge Pb of the sheet P is again pinched by the registration roller 9 and roller 10, and is further conveyed in the direction of the arrow mark D. At this point, the flapper 8 has already been pivoted downward (direction of arrow mark F), and therefore, the sheet outlet 4*b* has been closed by the tong-like portion 8*b* of the flapper 8. Thus, the sheet P is slid along the top surface of the flapper 8, that is, above the feed roller 7 and pickup roller 24, in the direction of the arrow mark D, and then, is discharged into the sheet delivery portion 5, that is, the top portion of the sheet tray 3.

There are three stages in the conveyance of the sheet P: the stage in which the sheet P is conveyed by the combination of the registration roller 9 and roller 10 while it remains pinched only by the combination of the registration roller 9 and roller 10, that is, the sheet P is held only by one area of the sheet P; the stage in which the sheet P is conveyed by the combination of the registration roller 9 and roller 10, and the combination of the sheet conveyance roller 17 and roller 18, remaining pinched by the two combinations, that is, the sheet P is held by two areas of the sheet P; and the stage in which the sheet P is conveyed while remaining pinched by the combination of the sheet conveyance roller 17 and roller 18 alone, that is, while the sheet P is held by only one area of the sheet P. Therefore, while the sheet P is conveyed by one or both of the combination of the registration roller 9 and roller 10, and the combination of the sheet conveyance roller 17 and roller 18, while remaining pinched by one or both of the combinations, recording can be made across the trailing edge portion of the sheet P (which is the leading edge portion while recording is made), as well as the leading edge portion of the sheet P (which is trailing edge portion while recording is made). Therefore, it is possible to record across the entirety of the recording surface of the sheet P, that is, from the leading edge Pa of the sheet P to the trailing edge Pb of the sheet P; it is possible to yield a border-less copy.

In this embodiment, it is after the leading edge portion of the sheet P is straightened by the registration roller 9 that the rotation of the registration roller 9 is started to restart the temporarily interrupted conveyance of the sheet P. Then, by the rotation of the cam portion 14*a* of the single control gear 14, the pressure plate 6 is allowed to move downward (direction of arrow mark B), allowing the sheet P to separate from the pickup roller 24, and the separation roller 7 is allowed to separate from the feed roller 7, allowing thereby the sheet P to separate from the feed roller 7 and separation roller 25. Thus, the sheet feeding/conveying apparatus in this embodiment is substantially smaller in the back tension which acts as the hindrance to the conveyance of the sheet P, than a sheet feeding/conveying apparatus in accordance with the prior art, while it prevents that two or more sheets P are conveyed together during the immediately subsequent sheet conveying operation. Also in this embodiment, the above described various portions of the sheet feeding/conveying operation are continuously carried out by the cam portion of the single control gear 14. In other words, the sheet feeding/conveying apparatus in this embodiment is simpler in structure, and does not require a special driving force source, such as a solenoid or the like, dedicated to the feeding and conveying of the sheet P of recording medium. Therefore, not only is the sheet feeding/conveying apparatus in this embodiment lower in cost, but also, more reliable than a sheet feeding/conveying apparatus in accordance with the prior art.

According to the above described preferred embodiment of the present invention, when the temporarily interrupted conveyance of the sheet P is restarted, the trailing edge portion of the sheet P remains held pinched by the separating means and conveying means. Therefore, the back tension, which acts as the hindrance to the sheet conveyance, is minimized. Therefore, the sheet conveyance can be smoothly restarted. As soon as the sheet conveyance is restarted, the separating means and conveying means separate from the sheet of recording medium, being therefore no hindrance to the further conveyance of the sheet P.

Further, this embodiment eliminates the need for providing a sheet feeding/conveying apparatus with a pinching means, or the like, for holding the trailing portion of a sheet of recording medium, and obviously, the mechanism for driving the pinching means or the like, in addition to the conveying means and separating means. In other words, this embodiment makes it possible to achieve cost reduction, and also, does not complicate the sequence for feeding and conveying the sheet P.

Further, at the point in time when a sheet P of recording medium comes into contact with the means for aligning the leading edge of the sheet P, the separating means and conveying means are kept pressed on the sheet P. Therefore, it does not occur that the sheet P is rendered askew by the frictional resistance which occurs between the sheet P and the various portions of the sheet conveyance passage while the sheet P is conveyed through the sheet conveyance passage. Therefore, the sheet feeding/conveying apparatus in this embodiment is superior to a sheet feeding/conveying apparatus in accordance with the prior art, in terms of straightening a sheet of recording medium by the leading edge aligning means.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 195455/2004 filed Jul. 1, 2004 which is hereby incorporated by reference.

What is claimed is:

1. A sheet material feeding apparatus comprising:

a pressure plate for supporting sheet materials;

a pickup roller for feeding the sheet materials supported on said pressure plate;

a feed roller for feeding the sheet materials fed by said pickup roller;

a separation roller for being urged by said feed roller and cooperable with said feed roller to separate one of the sheet materials;

a registration roller for feeding of the sheet material; and a pinch roller for making a nip with said registration roller, a separation roller holder rotatably supporting said separation roller; and a common control cam mechanism for controlling separation of said pressure plate from said pickup roller and for controlling rotation of said separation roller holder, wherein the sheet material fed by said feed roller is abutted against the nip between said registration roller and said pinch roller which are at rest, so that oblique feeding of the sheet material is corrected, and then said registration roller starts to feed the sheet material by the nip, and wherein when said registration roller starts to feed said sheet material by the nip, said pressure plate urges the sheet material to said pickup roller and said separation roller urges the sheet material to said feed roller, and said common control cam mechanism controls separation of said pressure plate from said pickup roller and rotation of the separation roller holder, such that after the sheet material is pinched between said registration roller and said pinch roller, said pressure plate is separated from said pickup roller, and thereafter, said separation roller is separated from said feed roller.

2. A sheet material feeding apparatus according to claim 1, further comprising a recording head for effecting recording on the sheet material fed by said sheet material feeding apparatus.

3. A sheet material feeding apparatus according to claim 2, further comprising a platen for supporting the sheet material at a position opposing to said recording head, wherein the recording is effected by said recording head when the sheet material is fed in an opposite direction between said recording head and said platen after passing between said recording head and said platen.

4. A sheet material feeding apparatus according to claim 3, wherein said registration roller discharges the sheet material having to be subjected to the recording to a sheet delivery tray.

5. A sheet material feeding apparatus according to claim 2, wherein said feed roller and said separation roller are spaced from each other after pressing of said pressure plate to said pickup roller is released.

* * * * *